United States Patent [19]

Bowsky et al.

[11] Patent Number: 4,739,551

[45] Date of Patent: Apr. 26, 1988

[54] HERMETIC TERMINAL ASSEMBLY PIN AND METHOD AND APPARATUS FOR MAKING THE SAME

[75] Inventors: Benjamin Bowsky, Maineville; Glenn A. Honkomp, Loveland; Larry G. Burrows, Cincinnati, all of Ohio; Roger W. Orlomoski, Westerly, R.I.

[73] Assignee: Emerson Electric Co., St. Louis, Mo.

[21] Appl. No.: 885,282

[22] Filed: Jul. 14, 1986

[51] Int. Cl.[4] ..... B21K 1/58; B21D 17/04

[52] U.S. Cl. ..... 29/882; 29/417; 72/88; 174/152 GM

[58] Field of Search ..... 29/874, 882, 412, 417; 72/88, 90; 174/152 GM

[56] References Cited

U.S. PATENT DOCUMENTS

| | | | |
|---|---|---|---|
| 3,295,005 | 12/1966 | Poellet et al. | 174/152 GM X |
| 3,550,250 | 12/1970 | Cervenka et al. | 29/837 X |
| 4,217,137 | 8/1980 | Kraska et al. | 174/152 GM X |
| 4,365,495 | 12/1982 | Francis | 72/88 |
| 4,461,925 | 7/1984 | Bowsky et al. | 174/152 GM |
| 4,584,438 | 4/1986 | Bowsky et al. | 174/152 GM |
| 4,754,910 | 10/1982 | Hutton | 29/882 X |

*Primary Examiner*—Timothy V. Eley

*Attorney, Agent, or Firm*—Polster, Polster and Lucchesi

[57] ABSTRACT

An improved hermetic terminal pin for conducting electrical current including a stop flange and fuse-like and locking groove areas adjacent thereto and a method and apparatus for manufacturing the terminal pin including the steps of feeding a wire material of preselected composition from a storage area to a cutting area and then to a roll forming area, the apparatus including die means to accomplish the roll forming step.

22 Claims, 4 Drawing Sheets

HERMETIC TERMINAL ASSEMBLY PIN AND METHOD AND APPARATUS FOR MAKING THE SAME

BACKGROUND OF THE INVENTION

The present invention relates to hermetic terminal assemblies and more particularly to an improved hermetic terminal pin and a method and apparatus for making the same.

It is known in the art of hermetic terminal assemblies to employ a current carrying terminal pin with a stop flange and a straight shank, each pin being surrounded by a sleeve and sealed in place within a lip defining a hole in the terminal body by means of a fusible material such as glass. Various arrangements of such hermetic terminal assemblies can be found in U.S. Pat. No. 4,296,275, issued to Benjamin Bowsky on Oct. 20, 1981, and U.S. Pat. No. 4,461,925, issued to Benjamin Bowsky and Glenn A. Honkomp on July 24, 1984.

In the past, the stop flanges for these current carrying terminal pins have been formed through what often has been referred to as a "cold heading" process wherein a pin blank is pressed between a reciprocable press and a base die, a flange forming recess being provided between the press and die so that the pressed pin blank assumes the flange form determined by the recess between the press and die. To provide a fuse-like area in the pin blank, a second metal working rolling step has been employed to roll a groove into the blank adjacent the "cold headed" flange. This past multi-step process has been comparatively expensive and of low productivity, the strength and current carrying properties of the pin sometimes being restricted by axial and lineal stresses and metal crystallization brought on by the cold heading and subsequent groove rolling steps.

The present invention recognizing these problems in the past methods of forming terminal pins provides a unique method and apparatus for forming terminal pins which have improved, uniform current carrying qualities, the novel method and apparatus therefor insuring substantially uniform metal density and consistently high quality current carrying terminal pins, permitting high productivity of these pins at comparatively low cost and with increased material savings. In addition, the resulting terminal pin has increased strength in the flange and flank portions where the same is desired and, at the same time, is provided with a preselected fuse-like area which accommodates for possible malfunctions in other parts of the assembly or the general apparatus with which the assembly is associated. Further, the novel method and apparatus of the present invention permits the ready use of preselected alloys, allowing for reduced forming operations and for controlled metal flow and displacement during such reduced forming operations to reduce metal waste, insure substantial uniform metal density, and improve consistent pin performance quality.

Various other features of the present invention will become obvious to one skilled in the art upon reading the disclosure set forth herein.

SUMMARY OF THE INVENTION

More particularly, the present invention provides a method of forming current carrying terminal pins for hermetic terminal assemblies comprising: feeding stock metallic wire material from a storage zone to a cutting zone; severing the wire while in the cutting zone to preselected pin blank size; feeding the pin blanks successively from the cutting zone to a roll forming zone; and, roll forming each of the blanks to displace a portion of the metal to form a radially extending flange in the pin blank with a reduced groove immediately adjacent thereto to provide a fuse-like area. In addition, the present invention provides novel die structure for rolling a terminal pin for a hermetic terminal assembly from a metallic pin blank comprising: planar surface means on the die structure face, the planar surface means being contoured to include metal displacing longitudinally extending lands therein having sides of differing angles of repose with respect to the planar surface means preselected to displace portions of the metal of the blank to a location intermediate the blank extremities to form a radially extending flange with the displaced metal in the pin blank and to leave a reduced groove in the pin blank immediately adjacent thereto to provide a fuse-like area. Further, the present invention provides a novel terminal pin for carrying current in a hermetic terminal assembly, the pin including a tapered flange extending radially from the body member, the body member having a pair of annular grooves on the opposite sides of the flange, one of which provides a fuse-like area in the pin and the other of which provides a lock on the flow of metal to prevent the pin blank in forming operations from elongating instead of forming the radially extending flange as is intended.

It is to be understood that various changes can be made by one skilled in the art without departing from the scope or spirit of the present invention. For example, in the method the metallic pin wire can be stored in other than roll form and can be cut to size by any one of a number of cutting or severing arrangements and in the die apparatus, the location of the grooves and angles can be varied, as can the groove depths to create various forms of flanges and fuse-like and locking groove areas.

BRIEF DESCRIPTION OF THE DRAWINGS

Referring to the drawings which disclose one advantageous embodiment of the inventive method, die structure and pin, FIGS. 2–13 being schematic in nature and grouped to selectively show individual features of the die structure.

DESCRIPTION OF THE PREFERRED EMBODIMENT

Figure 1:
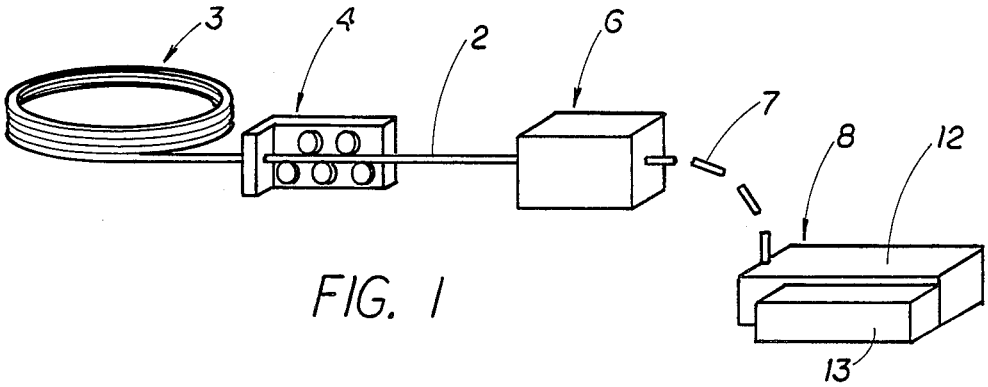
FIG. 1 is a schematic view in block form, the blocks representing the machine involved in carrying out each of the several steps of the inventive method.

Referring to FIG. 1 of the drawings, a wire 2 in roll form is fed from a storage and supply zone 3 through a suitable feeder 4 into a cutting zone 6 where it is cut in preselected lengths into metallic pin blanks 7, the pin blanks being subsequently fed successively from the cutting zone 6 to roll forming zone 8. In roll forming zone 8, a portion of pin blank metal of each pin blank is displaced radially from the longitudinal axis of the pin blank to form a radially extending stop flange 9 in the blank with a reduced groove immediately adjacent thereto to provide a fuse-like area 11 (FIG. 14), the material in the reduced groove 11 melting to breaking first when current through blank 7 becomes excessive. Roll formation of blanks 7 to provide terminal pins for hermetic terminal assemblies is accomplished through unique and novel die structure comprised of a pair of spaced, mating dies 12 and 13. Die 12 is reciprocably moveable relative stationary die 13 and slightly longer than stationary or short die 13. Details of the facing planar surfaces of the dies, which are substantially similar for roll forming of pin blanks 7, are described hereinafter. It is to be noted that advantageously wire 2 which can be any one of a number of suitable metallic materials such as solid stainless steel or copper cored stainless steel such as 446 S.S. can be stored in storage and supply zone 3 in the form of coils, but it also would be possible to store wire rods of appropriately selected metallic material and length in storage and supply zone 3. Any one of a number of known wire feeding and cutting mechanisms can be used to accomplish the feeding, cutting and die actuating steps of the inventive method and a commercial feeder such as one referred to as "Rapid Air" and a Hartford No. 312 Roller have been found satisfactory for these purposes, the novel invention resting in the several steps of the method for forming current carrying terminal pins for hermetic terminal assemblies, in the specific die structure used to accomplish the formation and in the pin itself.

Referring to FIGS. 2 through 13 and the sub groups thereof, various illustrations of the novel die structure are to be seen. It is to be understood that longer reciprocating die 12 and shorter stationary die 13 are secured in appropriate die actuating machinery (not described herein) in such a manner that spaced opposed planar surfaces are parallel with each other from top to bottom and spaced so that a cylindrical metallic pin blank 7 can be simultaneously rotated and squeezed as long die 12 is reciprocated past short stationary die 13. During the cycle, each blank 7 being rolled traverses the length of the spaced dies and the geometrical shapes in the die faces are impressed into the blank. At the finish end of the stroke, the re-shaped blank (FIG. 14) exits dies 12 and 13 and reciprocating die 12 returns to starting position to process another blank 7, which advantageously in the preferred embodiment of the invention is automatically fed to the dies. It is to be understood that terminal pin production rates with automatic machinery can vary from approximately 10 to 1000 pieces per minute depending on the equipment and parts rolled.

Figure 2C:
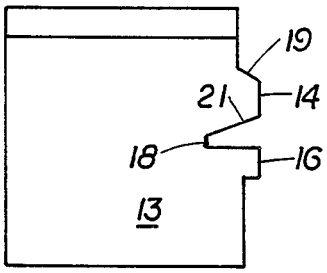
FIGS. 2*a*, 2*b* and 2*c* are schematic elevational face, bottom and enlarged entrance end views respectively, this group of views disclosing in general the pin rolling planar surface of the inventive die structure, this group of views omitting certain detailed features which, for purposes of clarity, are shown in later views of the drawings.
Figure 2A:
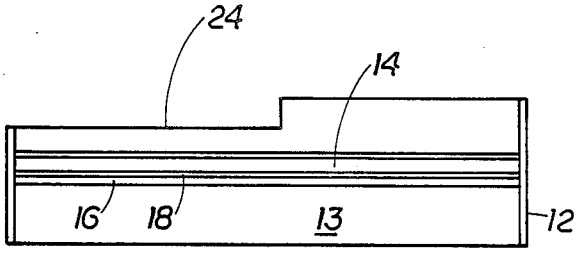
Figure 2B:
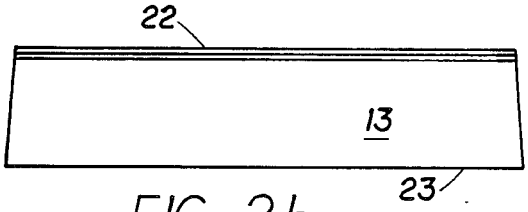
Figure 14:
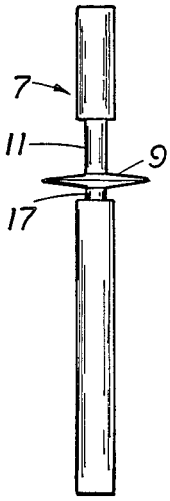

Referring to the group of FIGS. 2*a,* 2*b* and 2*c* of the drawings, particularly FIGS. 2*a* and 2*c* which disclose in general the pin rolling planar surface of inventive short stationary die 13 and the outer dimensions of longer reciprocating die 12, there can be seen particularly in end view FIG. 2*c,* the shape of the pin 7 external diameter after it has been formed (FIG. 14). In this regard, attention is directed to the spaced parallel shoulders or lands 14 and 16 which serve to form fuse-like groove area 11 and a secondary groove area 17 in pin blank 7, land 14 being contoured to create a deeper and wider groove 11 than groove 17 created by land 16, the locking groove 17 serving to control secondary metal flow during forming operations. As can also be seen particularly in FIG. 2*c* of the drawings, between spaced shoulders or lands 14 and 16 of the die structure there is a recessed section 18 into which metal displaced by lands 14 and 16 flows to create the tapered stop flange 9. It is to be noted in FIG. 2*c* that the slope from the horizontal of the upper and lower sides 19 and 21 respectively forming the land 14 differ, with the slope of side 19 from the horizontal being approximately 30° and the slope of side 21 from the horizontal being approximately 65°. It also is to be noted in FIG. 2*b,* bottom view, that the shorter stationary die 13 tapers outwardly at both end extremities approximately 5° from grooved planar working surface 22 of the die 13 to the opposite nonworking surface 23 for holding the die in place. Finally, it is to be noted that the upper portion of only shorter die 13 is stepped down at 24 longitudinally from the entrance end to approximately halfway to the exit end of the die to accommodate for the die functions as described hereinafter for FIGS. 11*a*—11*c.* It is to be understood that although only groove details of the working surface 22 of shorter stationary die 13 are described in detail herein, the grooved working surface of reciprocating die 12 can be substantially similar, except as otherwise indicated herein.

Figure 3C:
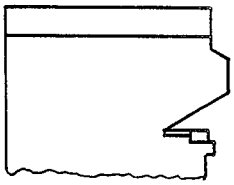
FIGS. 3*a*, 3*b*, and 3*c* partial elevational face, cross-sectional and enlarged end views, respectively, this group of views serving to disclose details of the compound angles in the sides of the lands of the die structure for formation of the upper groove, in each pin blank, the cross-sectional view being taken in a plane through line 3*b*—3*b* of FIG. 3*a*.
Figure 3A:
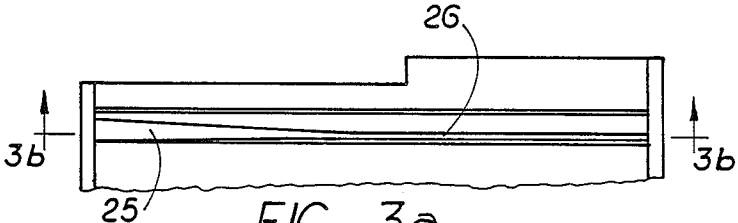
Figure 3B:
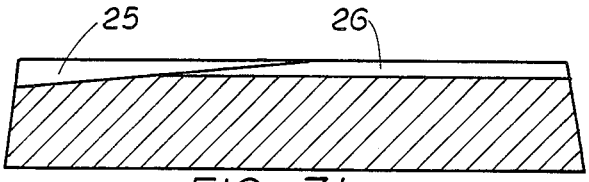

Referring to the group of FIGS. 3*a*, 3*b*, and 3*c* of the drawings, which disclose details of the compound angles employed in the land sides 14 of the die structure for formation of the upper groove 11 in pin blank 7, the reference numeral 25 in this group of figures serves to disclose the angles of variation used to direct displaced metal in the upper groove forming operation downwardly toward the flange forming channel 18 (FIG. 2*c*) in the die structure. In this regard, it is to be noted that a little less than approximately one half of the die groove length, as indicated at 26, serves as a dwell zone to finally work and maintain that portion of the selected form as seen in FIG. 14.

Figure 4B:
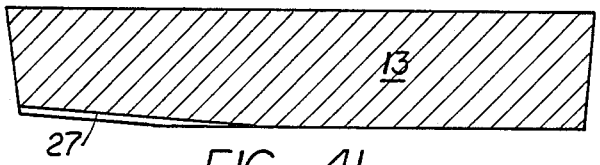
FIGS. 4*a*, 4*b* and 4*c* are partial elevational face, cross-sectional and enlarged end views, respectively, this group of views serving to disclose details of the compound angles in the sides of the lands of the die structure for formation of the lower groove in each pin blank, the cross-sectional view being taken a plane through line 4*b*—4*b* of FIG. 4*a;*
Figure 4C:
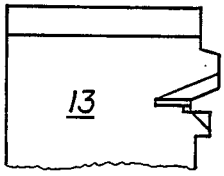
Figure 4A:
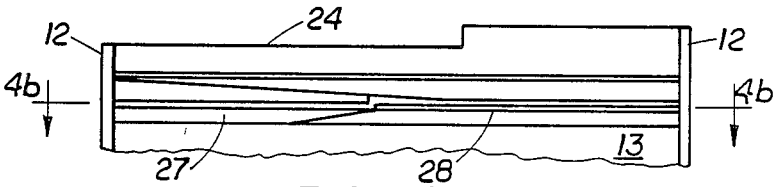

Referring to the group of FIGS. 4*a*, 4*b* and 4*c* of the drawings, which disclose details of the compound angles employed in the land sides of land 16 of die structure for formation of the lower groove 17 in pin blank 7, the reference numeral 27 in this group of figures serves to disclose the angles of variation used to direct displaced metal in the lower groove forming operation upwardly toward the flange forming channel 18 (again FIG. 2*c*) in the die structure. In this regard, it is to be noted that a little more than approximately one half of the die groove length, as indicated at 28, serves as a dwell zone to finally work and maintain that portion of the selected form as seen in FIG. 14.

Figure 5B:
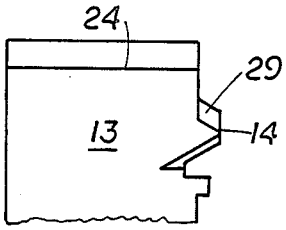
FIGS. 5*a* and 5*b* are partial elevational face and enlarged end views, respectively, this group of views serving to disclose details of the compound angles in the sides of the groove forming lands to direct metal to an extremity of the pin blank.
Figure 5A:
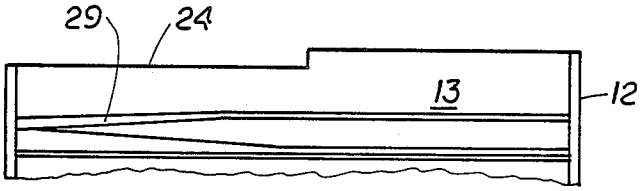

Referring to FIGS. 5*a* and 5*b* of the drawings, a compound angle 29 is disclosed in the upper side of land 14, this compound angle serving to direct excess displaced metal in the formation of upper groove area 11 toward the upper extremity of pin blank 7. This is necessary since the volume of metal displaced in forming groove area 11 exceeds the amount of metal required for stop flange 9 formed in recess 18.

Figure 6B:
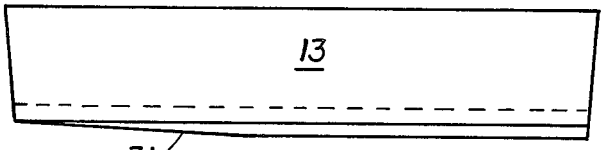
FIGS. 6*a* and 6*b* are elevational face and top views, respectively, this group of views serving to disclose details of the entrance end ramp angle.
Figure 6A:
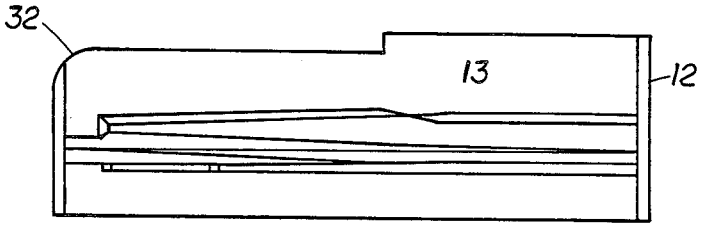

Referring to the group of FIGS. 6*a* and 6*b* of the drawings, a ramp angle 31 extending from the entrance to less than one half the die length is provided to assure gradual land penetration for a given distance along the die length, allowing gradual metal displacement along the die length and preventing pin blank slippage and concomitant distortion. It is to be noted that the upper corner 32 at the die entrance end is rounded or chamfered to permit and facilitate die blank insertion and rotation of the blank about its axis for subsequent metal displacement by the die structure.

Figure 7B:
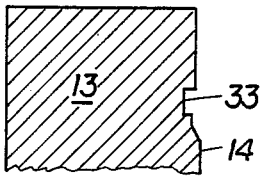
FIGS. 7*a* and 7*b* are partial elevational face and cross-sectional views, respectively, this group of views serving to disclose a reservoir groove for metal spillover, the cross-sectional view being taken in a plane through line 7*b*—7*b* of FIG. 7*a;*
Figure 7A:
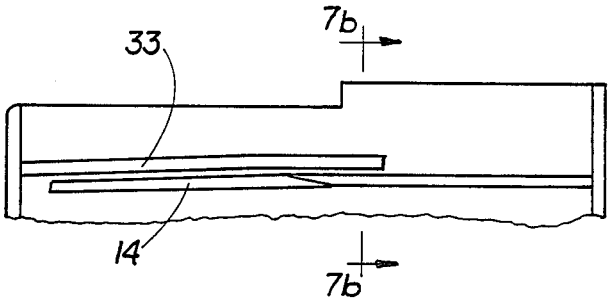

Referring to the group of FIGS. 7*a* and 7*b*, there is disclosed a reservoir 33 which follows the compound angle 29 in land 14 which as aforedescribed serves to direct excess metal upwardly in the formation of upper groove 11, the reservoir groove 33 receiving some of the upwardly displaced metal in the early part of the rolling cycle, the metal being subsequently rolled back toward the groove forming land 14 which forms groove 11 as the pin blank approaches the exit end of the die structure—assuring good edge definition along the periphery of rolled groove 11. It is to be noted in FIG. 7*a*, that reservoir 33 follows the angle of the groove forming land 14 and then runs horizontal with land 14 briefly, extending longitudinally for a little more than one half of the length of the die structure.

Figure 8A:
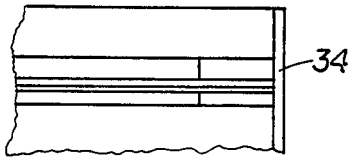
FIGS. 8*a* and 8*b* are partial elevational face and plan views, respectively, of the exit end of the moveable or long die disclosing an exit end ramp angle.
Figure 9A:
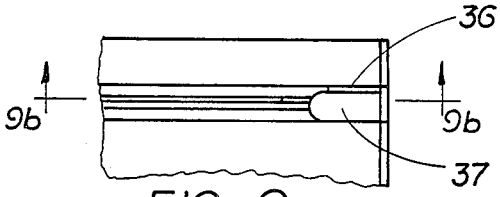
FIGS. 9*a* and 9*b* are partial elevational face and cross-sectional views, respectively, disclosing a relief cavity and ramp relief at the exit end of the die structure, the cross-sectional view being taken in a plane through line 9*b*—9*b* of FIG. 9*a;*
Figure 8B:
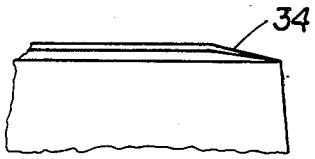
Figure 9B:
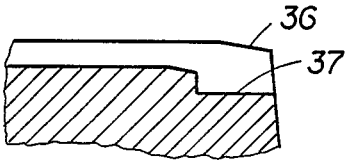

Referring to the group of FIGS. 8*a* and 8*b* of the drawings, the plan and elevational view of the exit end of the longer die 12 shows a ramp type relief angle 34 on the crest of the groove forming lands (such a relief being applicable to both dies) and the group of FIGS. 9*a* and 9*b* shows a ramp type relief angle 36 and a relief cavity 37. These reliefs serve to avoid pinching of the pin blanks 7 by the die structure when the rolling load in forming a blank 7 has been dissipated and the die structure, which has yielded to the radial loads developed during rolling, springs back to normal position.

Figure 10B:
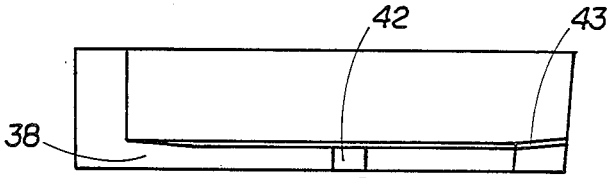
FIGS. 10*a,* 10*b* and 10*c* are partial elevational face plan and entrance and views, respectively, this group serving to disclose the novel shelf arrangement for the short die of the die structure.
Figure 10C:
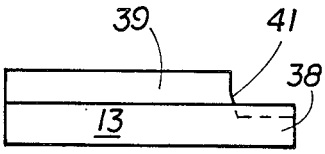
Figure 10A:
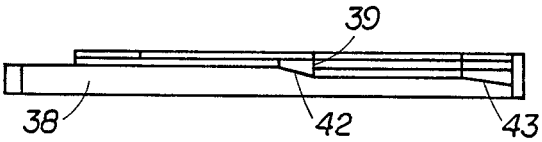

Referring to the group of FIGS. 10*a*, 10*b* and 10*c* of the drawings, details of the shelf support on the short die 13 are disclosed. In FIG. 10*c* which discloses the entrance end of the die structure 13 it can be seen that lower shelf 38 extends beyond the end of the roll forming section 39 to provide a seat for the extremity of pin blank 7 as it enters the die structure. It is to be understood that the distance between the roll forming lands and the shelf 38 can be selected in accordance with pin blank size and location of flange 9 thereon, the shelf serving to restrict axial extrusion of metal into the length of each blank 7 when the flange 9 is rolled into the blank. As can also be seen in FIG. 10*c*, a chamfer 41 is provided between body 39 and shelf 38 to provide a lead for the extremity of pin blank 7 as it rests on shelf 38. It is to be noted in FIGS. 10*a* and 10*b*, that shelf 38 extends better than half of the working length of the die structure before a step relief 42 is provided in the shelf to prevent the blank from locking up in the dies after flange 9 has been formed. Further, a relief angle 43 is provided at the exit end of the die structure to allow blank 7 to exit without metal distortion.

Figure 11B:
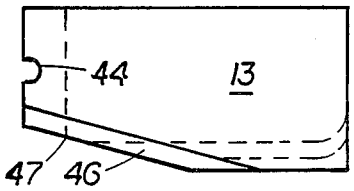
FIGS. 11*a,* 11*b,* and 11*c* are partial elevational face, plan and end views of the entrance end of the short die structure, this group serving to disclose what occurs as the pin blanks enter the die structure.
Figure 11C:
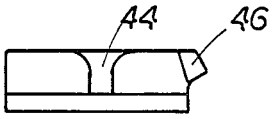
Figure 11A:
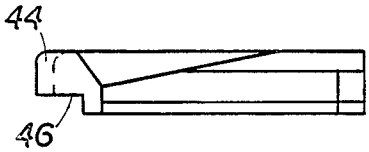

Referring to the group of FIGS. 11*a*, 11*b* and 11*c* of the drawings, these figures serve to further disclose the upper portion of the die structure at the entrance edge of the cooperating dies and particularly the guide on the short die 13 for the pin blanks 7 as these blanks are introduced unto the stop shelf 38 (FIGS. 10*a*, 10*b* and 10*c*). The notch 44 at the entrance edge of the die serves as a guide for the pin blanks as they enter into the die structure, the overhang 46, limiting axial growth of the upper extremity of the blank in form rolling operations. It is to be noted that a ramp angle 47 which is compounded allows for gradual introduction of the blank into the roll forming operation.

Figure 12:
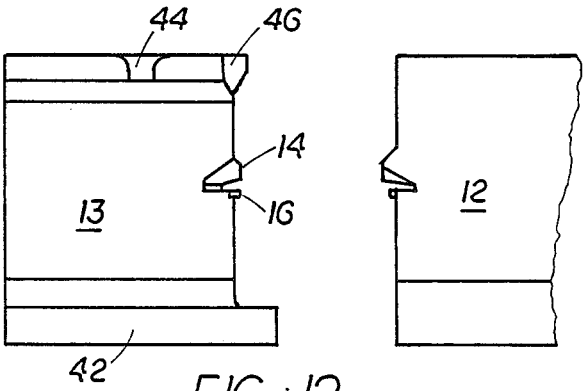
FIG. 12 is an enlarged entrance end view of the long and short die structure assembly.
Figure 13:
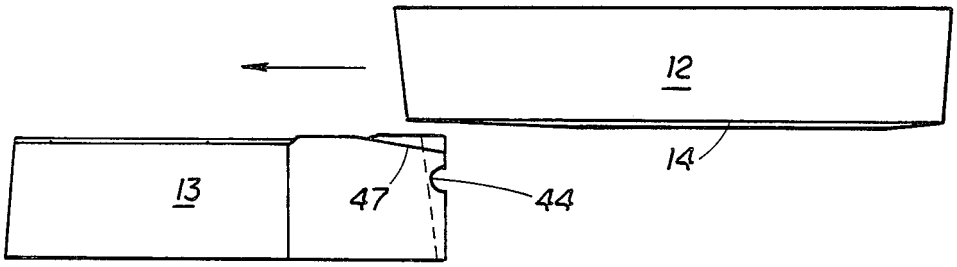
FIG. 13 is a plan view of the long and short die structure assembly in starting position to roll a pin blank; and, FIG. 14 is an enlarged elevational view of the novel terminal pin of the present invention.

Referring to FIGS. 12 and 13, end and plan views of the overall die assembly including long and short dies can be seen, including the spaced groove forming lands or shoulders 14 and 16 on the cooperating planar faces of the spaced stationary (shorter die 13) and reciprocable (longer die 12) dies. Attention also is directed to pin blank guide notch 44 and the opposed stops 42 and 46 (FIG. 12) which control and restrict the axial growth of each blank being rolled at opposite extremities of the blank.

In carrying out the several steps of the inventive method, using the inventive die structure apparatus described herein, a suitable stainless steel wire coil, such as 446 S.S. having an approximate weight of 100 pounds is inserted into supply zone 3, fed by feeders 4 into cutting zone 6 where appropriate length terminal pin blanks 7 are cut to size. These pin blanks are then successively fed into the roll forming zone 8 which includes shorter stationary die 13 having its pin forming planar surface selectively spaced from and substantially parallel the similar pin forming planar surface of reciprocable longer die 12. The notched groove 44 in shorter die 13 serves to guide each blank 7 as it is introduced into the dies and the ramp angles 31 and 36 allow for gradual penetration of each blank as it is roll formed between the lands 14 and 16 of the spaced dies. As the pin progresses between the reciprocating and stationary die structure metal is displaced along the compound angles of the sides of spaced lands 14 and 16, the metal being displaced downwardly by the sides of land 14 and upwardly by the sides of land 16 to flow into recess 18, thus forming tapered stop flange 9 on each pin blank 7 and the immediately adjacent grooved fuse-like area 11 and locking groove area 17.

Advantageously, the stock wire 2 can comprise a stainless steel composition of approximately 5% to approximately 40% chromium by weight and preferably approximately 23% to approximately 27% chromium by weight. Alternatively, a stainless steel composition of approximately 30% to 60% nickel by weight and preferably approximately 48% to approximately 52% nickel by weight. It also has been found satisfactory to utilize a stainless steel stock of approximately 2% to 20% nickel and approximately 10% to 40% chromium by weight and advantageously approximately 26% chromium and approximately 4% nickel by weight. It further has been found satisfactory to utilize a stock of low carbon steel up to approximately 0.16% carbon by weight. Moreover, it is to be understood that a stock wire having a copper core and stainless steel jacket of a suitably selected composition as aforedescribed can be employed.

In the rolling operation and with the compound angle die structure aforedescribed, the major portion of the metal flows downwardly in gradually increasing amounts at successive preselected flow angles to the blank axis of approximately 30° and 65% and a minor portion of the metal flows upwardly at a preselected angle of approximately 30° with a minor portion of metal flowing to opposite pin blank extremities where it is restricted from further flow by aforedescribed shelf 38 and overhang 46 to control axial growth at either end of the blank. As aforenoted suitable reservoir means 33 allows for metal control in the early stage of the operation, the metal being reintroduced at a later stage of the rolling operation. Further, as above discussed, appropriate reliefs are provided in the die structure at the exit end to avoid blank distortion.

Thus, as can be seen in FIG. 14, a unique, strong terminal pin capable of effective and continuous uniform current carrying performance is produced in a straightforward, efficient and economical manner with a minimum of waste and a maximum of production, the terminal pin having a strong, tapered stop flange 9 intermediate the extremities thereof and a pair of spaced annular grooves 11 and 17 of different uniform depths to provide both fuse-like and locking groove areas.

The invention claimed is:

1. A method of forming current carrying terminal pins for hermetic terminal assemblies comprising:

feeding stock metallic wire material from a storage zone to a cutting zone;

severing said wire while in said cutting zone to preselected pin blank size;

feeding said pin blanks successively from said cutting zone to a roll forming zone; and, roll forming each of said pin blanks to displace a portion of the metal relative the longitudinal axis of said pin blank to form a radially extending flange in said pin blank with a reduced groove immediately adjacent thereto to provide a fuse-like area which melts to breaking first when current through a pin becomes excessive.

2. The method of claim 1, wherein said stock wire material is of stainless steel stored in rolled form in said storage zone.

3. The method of claim 1, said roll forming step including feeding each pin between a pair of spaced, opposed, complementary roll forming dies with the longitudinal axis of the pin being normal to the longitudinal axes of said dies and moving at least one die in a direction along its longitudinal axis relative the longitudinal axis of the other to radially displace the metal to form said flange and fuse-like poriton in said pin.

4. The method of claim 1, said roll forming step including displacing a portion of the metal from each side of the displaced radially extending flange in said pin to limit axial stretch.

5. The method of claim 1, said stock wire material comprising a stainless steel composition of approximately 5% to approximately 40% chromium by weight.

6. The method of claim 1, said stock wire material comprising a stainless steel composition of approximately 23% to approximately 27% chromium by weight.

7. The method of claim 1, said stock wire material comprising a stainless steel composition of approximately 30% to approximately 60% nickel by weight.

8. The method of claim 1, said stock wire material comprising a stainless steel composition of approximately 48% to approximately 52% nickel by weight.

9. The method of claim 1, said stock wire material comprising a stainless steel composition of approximately 2% to 20% nickel and approximately 10% to 40% chromium by weight.

10. The method of claim 1, said stock wire material comprising a stainless steel composition of approximately 26% chromium and approximately 4% nickel by weight.

11. The method of claim 1, said stock wire material comprising a low carbon steel up to approximately 0.16% carbon by weight.

12. The method of claim 1, said stock wire material comprising a copper core and a jacket of stainless steel of preselected composition.

13. The method of claim 1, wherein in said roll forming step for each of said pin blanks at least a major portion of pin blank metal from one end of each pin blank is displaced through metal flow away from said pin blank extremity at a preselected flow angle to the pin blank longitudinal axis in forming said pin flange and fuse-like area groove in said pin blank.

14. The method of claim 1, wherein in said roll forming step for each of said pin blanks at least a major portion of pin blank metal from one end of each pin blank is displaced through metal flow away from said pin blank extremity at successive preselected flow angles to the pin blank longitudinal axis in forming said pin flange and fuse-like area groove in said pin blank.

15. The method of claim 1, wherein in said roll forming step for each of said pin blanks at least a major portion of pin blank metal from one end of each blank is displaced through metal flow away from said pin blank extremity at successive preselected flow angles of approximately 30° and 65° to the pin blank longitudinal axis in forming said pin flange and fuse-like area groove in said pin blank.

16. The method of claim 1, wherein in said roll forming step for each of said pin blanks at least a major portion of pin blank metal from one end of each pin blank is displaced through metal flow away from said pin blank extremity at a preselected angle to the pin blank longitudinal axis in forming said pin flange and fuse-like area groove in said blank; and, a controlled minor amount of pin blank metal is displaced through metal flow toward said pin blank extremity to control the amount of metal flowing to said flange.

17. The method of claim 1, wherein in said roll forming step for each of said pin blanks at least a major portion of pin blank metal from one end of each pin blank is displaced through metal flow away from said pin blank extremity in gradually increasing amounts at a preselected angle to the pin longitudinal axis in forming said pin flange and fuse-like area groove in said blank.

18. The method of claim 1, wherein in said roll forming step for each of said pin blanks at least a major portion of pin blank metal from one end of each pin blank is displaced through metal flow away from said pin blank extremity at a preselected angle to the pin longitudinal axis in forming said pin flange and fuse-like area groove in said blank, a preselect quantity of said metal flow being controlled so as to flow into a reservoir during the early stage of said roll forming step and then reintroduced at a later stage of said roll forming step.

19. The method of claim 1, wherein in said roll forming step for each of said pin blanks at least a major portion of pin blank metal from one end of each pin blank is displaced through metal flow away from said pin blank extremity at a preselected angle to the pin longitudinal axis in forming said pin flange and fuse-like area groove in said blank, metal flow relief being provided in the later stage of each roll forming step to avoid flange distortion.

20. The method of claim 1, wherein in said roll forming step for each of said pin blanks at least a major portion of pin blank metal from one end of each pin blank is displaced through metal flow away from said pin blank extremity at a preselected angle to the pin longitudinal axis in forming said pin flange and fuse-like area groove in said blank, the metal flow at at least one of said extremity of said pin blank being restricted to limit axial extrusion.

21. The method of claim 1, wherein in said roll forming step for each of said pin blanks at least a major portion of pin blank metal from one end of each pin blank is displaced through metal flow in a direction away from said pin blank extremity at a preselected angle to the pin longitudinal axis in forming said pin flange and a fuse-like area groove in said blank; and, a minor portion of pin blank metal from the opposite end of each pin blank is displaced through metal flow in a direction away from said pin blank extremity at said opposite end at a preselected angle to the pin longitudinal axis in forming said pin flange and a locking groove in said blank.

22. The method of claim 21, said preselected angle for said minor portion of metal flow being approximately 30°.

* * * * *